US005370279A

United States Patent [19]

Tardif

[11] Patent Number: 5,370,279

[45] Date of Patent: Dec. 6, 1994

[54] SQUEEZE CANTEEN FOR DISPENSING A LIQUID

[76] Inventor: Pierre Tardif, 206 St. Jacques, Longueuil, Quebec, Canada, J4H 2Y1

[21] Appl. No.: 205,162

[22] Filed: Mar. 3, 1994

[51] Int. Cl.[5] ..... B65D 37/00

[52] U.S. Cl. ..... 222/214; 222/531; 251/4; 251/9; 251/354; 215/229

[58] Field of Search ..... 222/528, 530, 531, 212, 222/214; 251/4, 9, 10, 7, 354; 215/229, 1 A; 220/705, 707; 138/119

[56] References Cited

U.S. PATENT DOCUMENTS

| | | | |
|---|---|---|---|
| 1,236,273 | 8/1917 | Decker | 222/530 |
| 2,002,835 | 5/1935 | Rose | 251/10 |
| 3,191,622 | 6/1965 | Finlayson | 251/354 X |
| 4,453,653 | 6/1984 | Chapelsky et al. | 222/530 X |
| 4,735,329 | 4/1988 | Le | 215/229 |
| 5,150,815 | 9/1992 | Saklad | 215/229 X |
| 5,259,538 | 11/1993 | Tardif | 222/528 |
| 5,273,172 | 12/1993 | Rossbach et al. | 222/530 X |

*Primary Examiner*—Gregory L. Huson
*Attorney, Agent, or Firm*—Michael Ebert

[57] ABSTRACT

A squeeze canteen for dispensing a potable liquid such as drinking water or fruit juice, the canteen including a container formed of resilient material for holding the liquid. The container is closed by a removable cap provided with a nozzle in the form of a normally upright, flexible tube mounted on a nipple and projecting from the cap, the inlet of the tube communicating with the container. When the canteen is in its drinking mode and the container is squeezed, the resultant internal pressure forces liquid from the container through the upright tube from which it is ejected. Associated with the cap is a crimping device constituted by a flexible lug one end of which is anchored on the cap. The lug being provided with an elongated slot through which the tube extends. The lug is manipulated by the user so that in the drinking mode it is folded over to permit the tube to assume its normal upright position. In the sealing mode the lug is unfolded to extend away from the cap and in doing so to deflect the tube to impart a bend thereto to block the flow of liquid.

6 Claims, 2 Drawing Sheets

SQUEEZE CANTEEN FOR DISPENSING A LIQUID

BACKGROUND OF INVENTION

1. Field of Invention

This invention relates generally to canteens for storing potable liquids, and more particularly to a squeeze canteen provided with a closable nozzle tube that when the canteen is squeezed and the tube is open then ejects a stream of liquid.

2. Status of Prior Art

A canteen is a flask for carrying drinking water or other potable liquids. Canteens are now commonly used by hikers and other travelers to carry potable liquids such as drinking water and fruit juice. Usually a canteen takes the form of a metal or plastic flask having a removable screw-on cap. These are not suitable for preschool or very young children; for in order to drink from a conventional canteen, the child must unscrew the cap, which is usually chained to the flask, and then put the threaded neck of the flask into his mouth. Since the flask is filled with liquid and is fairly heavy, a yound child runs the risk of hitting and damaging his teeth with the hard, threaded neck of the flask.

A conventional canteen operates on the gravity flow principle. In order, therefore, to drink from this canteen, the user must raise it to a level at which the liquid will flow downwardly into his mouth. This presents a problem when the user of the canteen is a child on a moving vehicle, for then it is difficult for the user to hold the canteen steady.

Moreover, there are many situations in which it is not convenient to use a conventional canteen or liquid container. For example, in a marathon race in which a runner carries with him a plastic bottle containing water, the runner is not in a position to unscrew the cap of the bottle and raise the bottle to his lips so that he can drink from it, for this is difficult to do without coming to a halt and losing ground.

The need exists, therefore, for a canteen from which one can drink without having to unscrew a cap and without having to put the threaded neck of the canteen into the mouth.

Of prior art interest is my U.S. Pat. No. 5,259,538 and the references cited therein.

SUMMARY OF INVENTION

In view of the foregoing, the main object of this invention is to provide a squeeze canteen for storing a potable liquid and for ejecting the liquid as a jet stream when the canteen is squeezed.

Among the many advantages of this invention are that it obviates the need to unscrew the cap of the canteen in order to drink, and it does away with the need to raise the canteen to a position producing gravity flow, for the liquid will be ejected from the canteen only when it is squeezed.

More particularly, an object of this invention is to provide a squeeze canteen in which the liquid is ejected through a closable nozzle in the form of a normally upright, flexible tube which, when deflected and held in a bent state, then closes the nozzle and thereby seals the canteen.

Still another object of the invention is to provide a squeeze canteen that operates efficiently and reliably and can be mass-produced at low cost.

Briefly stated, these objects are attained in a squeeze canteen for dispensing a potable liquid such as drinking water or fruit juice, the canteen including a container formed of resilient material for holding the liquid. The container is closed by a removable cap provided with a nozzle in the form of a normally upright, flexible tube that projects from the cap, the inlet of the tube communicating with the container.

When the canteen is in its drinking mode and the container is squeezed, the resultant internal pressure forces liquid from the container through the upright tube from which it is ejected. Associated with the cap is a crimping device which, when operated by the user, puts the canteen in a sealing mode, the crimping device then deflecting the nozzle tube and holding it in a bent state to block the flow of liquid and thereby seal the container.

In one preferred embodiment of a canteen in accordance with the invention, the crimping device associated with the cap is constituted by a lug of flexible material, one end of which is anchored on the nipple, the other end being formed into a finger for manipulating the lug. The lug includes an elongated slot which extends to the finger, the tube passing through the slot. To put the canteen in its drinking mode, the lug is folded over to permit the tube to project upwardly from the cap through the slot and put the canteen in its sealing mode. To put the canteen in its sealing mode, the lug is unfolded to cause the tube to bend at a point adjacent the nipple and thereby block the flow of liquid.

BRIEF DESCRIPTION OF DRAWINGS

For a better understanding of the invention as well as other objects and further features thereof, reference is made to the following detailed description to be read in conjunction with the accompanying drawing, wherein.

DESCRIPTION OF INVENTION

Figure 1:
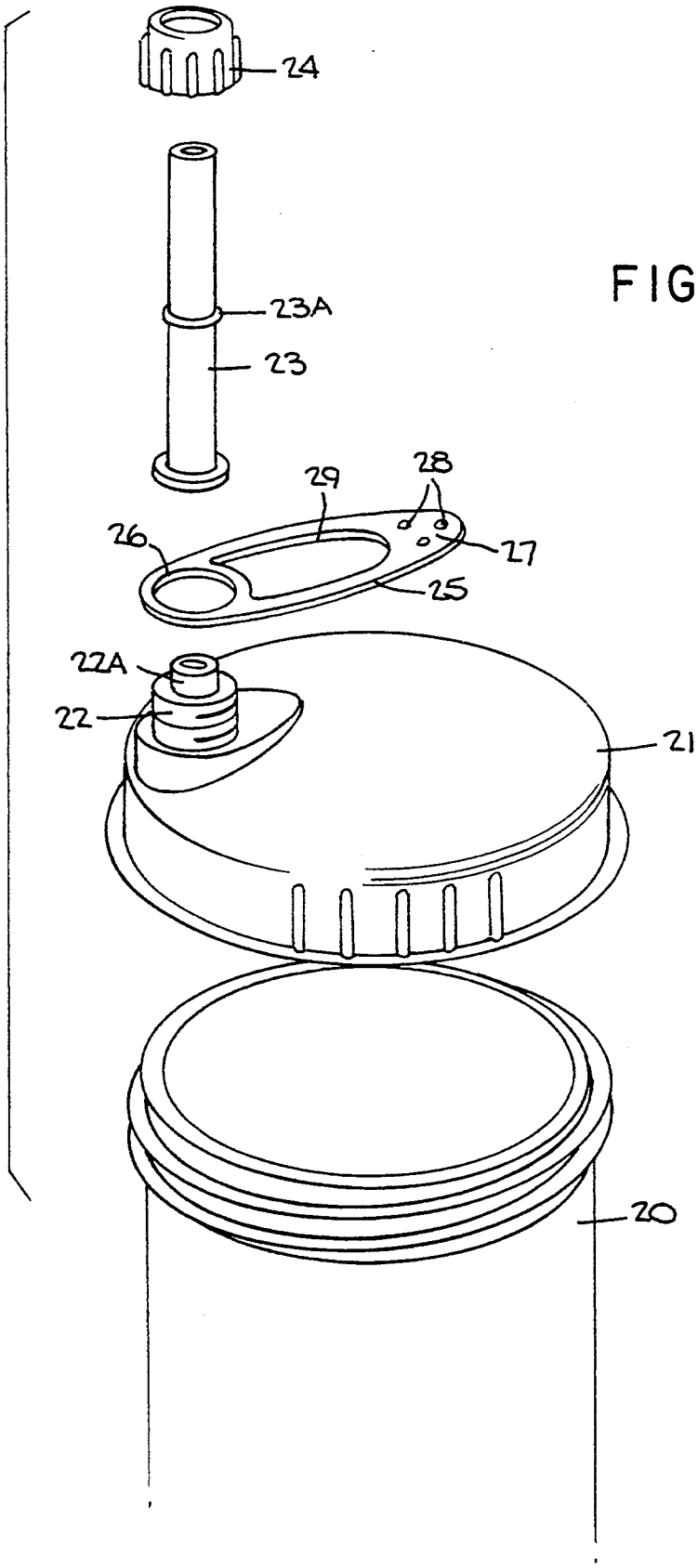
FIG. 1 is an exploded view of a preferred embodiment of a squeeze canteen in accordance with the invention.
Figure 2:
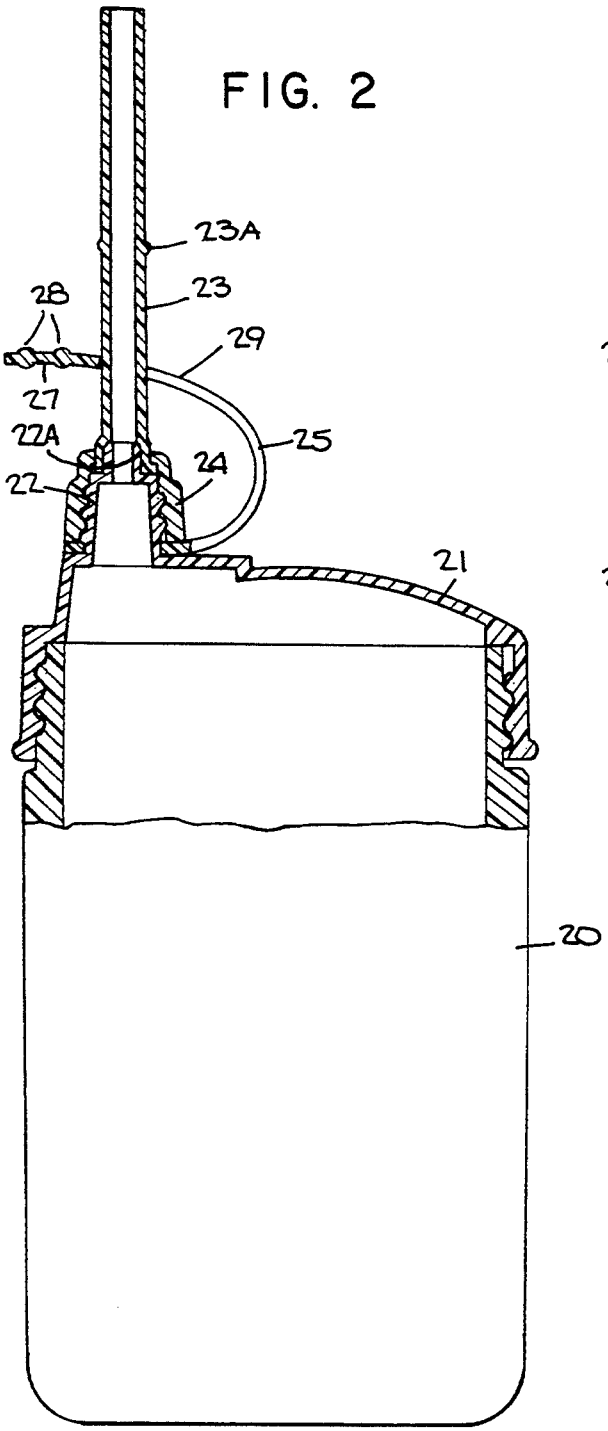
FIG. 2 is a sectional view of the assembled canteen.
Figure 3:
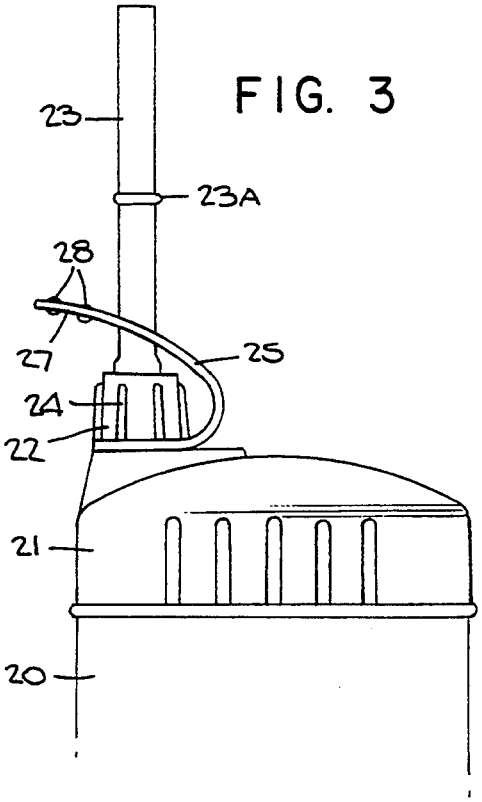
FIG. 3 shows the same canteen in its drinking mode.
Figure 4:
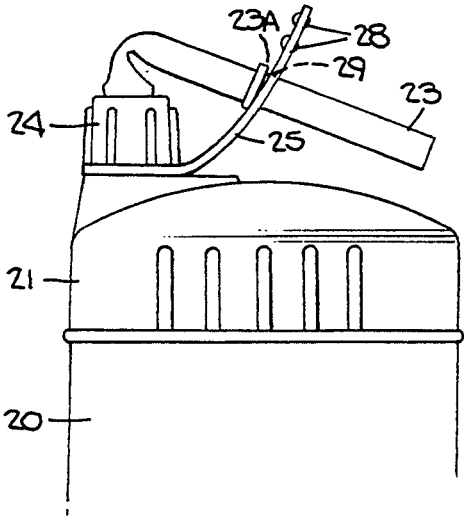
FIG. 4 shows the same canteen in its sealing mode.

In the squeeze canteen shown in FIGS. 1 to 4 use is made of a cylindrical container 20 formed of transparent, resilient, synthetic plastic material for storing a supply of the potable liquid to be dispensed. The mouth of container 20 is externally threaded to receive a cylindrical screw-on plastic cap 21.

Cap 21 which has a dome-shaped top wall, is provided adjacent its periphery with an externally-threaded nipple 22 having a teat 22A extending therefrom which is inserted in the inlet end of a short, flexible plastic nozzle tube 23. The tube is provided at an intermediate position thereon with a stop ring 23A. Tube 22 which extends from the nipple and is normally upright, is anchored on the nipple by an internally threaded collar 24.

The crimping device in this embodiment of the squeeze canteen is constituted by a lug 25 of synthetic plastic resilient material having at one end a mounting hole 26 for anchoring the lug on nipple 22, the lug being held in place by collar 24 which screws onto the nipple. The other end of lug 25 is formed into a finger 27 having friction pimples 28 thereon so that the lug can be grasped and manipulated by the user of the canteen.

The lug also includes an elongated slot 29 which extends between mounting hole 26 and finger 27.

Nozzle tube 23 goes through slot 29 of the lug and is never disengaged from lug 25. To put the squeeze canteen in its drinking mode, the user manipulates the lug by its finger 27 to fold lug 25 over nozzle 22 and thereby permit the tube to assume its normal upright position, as shown in FIG. 10. One can now drink from the canteen by squeezing container 20 to eject liquid through the nozzle tube.

When one wishes to put the canteen in its sealing mode, then as shown in FIG. 11, the lug is unfolded, to extend away from nipple 22. This action causes tube 23 to bend at right angles at a point adjacent nipple 22, thereby blocking liquid flow from the tube.

Since the bent tube which is of resilient material, then seeks to regain its upright position, it applies pressure to the unfolded lug which resists movement of the lug. And the stop ring 23A on the tube which now engages the outer side of the lug serves to resist pull out of the tube.

Thus it is a simple matter with this canteen to switch it from its drinking mode to its sealing mode, for one has only to manipulate the lug so as to fold it over or unfold it.

While there has been shown a preferred embodiment of the invention, it will be appreciated that many changes may be made therein that lie within the inventive concept.

I claim:

1. A squeeze canteen for dispensing a potable liquid, said canteen comprising:

(a) a container formed of resilient, synthetic plastic material for holding the liquid and having an outlet;

(b) a removable cap covering the outlet and provided with a nozzle tube of flexible plastic material that is anchored on the cap and is normally upright, the inlet of the tube communicating with the container, whereby in a drinking mode of the canteen in which the container is squeezed, the resultant internal pressure forces liquid from the container through the tube from which it is ejected; and (c) a crimping device associated with the cap, which in a sealing mode of the container deflects the nozzle tube and holds it in a bent state to block the flow of fluid therethrough, and in said drinking mode permit the tube to resume its normally upright position, the crimping device being constituted by a lug of flexible material, one end of which is anchored on the cap adjacent the inlet of the tube, the lug being provided with an elongated slot through which the tube passes, the lug being manipulatable by a user so that in the drinking mode it is folded over to permit the tube to assume its normal upright position, and in the sealing mode is unfolded to extend away from the inlet and in doing so to deflect the tube to impart a bend thereto.

2. A canteen as set forth in claim 1, in which the inlet of the tube is mounted on an externally-threaded nipple formed on the cap, the tube being held to the nipple by an internally-threaded collar.

3. A canteen as set forth in claim 2, in which the lug is provided adjacent its one end with a mounting hole to support the lug on the nipple so that it is clamped by the collar.

4. A canteen as set forth in claim 3, in which the other end of the lug is formed into a finger for manipulating the lug.

5. A canteen as set forth in claim 1, in which the tube is provided at an intermediate position with a stop ring which when the lug is unfolded and the tube is bent, engages the lug to resist withdrawal of the tube from the lug.

6. A canteen as set forth in claim 1, in which the container is of transparent material.

* * * * *